US008816909B2

(12) United States Patent
Jiang et al.

(10) Patent No.: US 8,816,909 B2
(45) Date of Patent: Aug. 26, 2014

(54) SMALL BROADBAND LOOP ANTENNA FOR NEAR FIELD APPLICATIONS

(75) Inventors: Bing Jiang, San Diego, CA (US); Richard John Campero, San Clemente, CA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 183 days.

(21) Appl. No.: 13/441,439

(22) Filed: Apr. 6, 2012

(65) Prior Publication Data

US 2012/0262353 A1 Oct. 18, 2012

Related U.S. Application Data

(60) Provisional application No. 61/475,109, filed on Apr. 13, 2011.

(51) Int. Cl.
*H01Q 1/38* (2006.01)

(52) U.S. Cl.
USPC ..... 343/700 MS; 343/742

(58) Field of Classification Search
CPC ..... H01Q 7/00; H01Q 7/005; H01Q 7/2208; H01Q 1/38; H01Q 21/30
USPC ..... 343/700 MS, 702, 748, 846, 741, 742
See application file for complete search history.

(56) References Cited

U.S. PATENT DOCUMENTS

| | | | | |
|---|---|---|---|---|
| 6,396,264 | B1 | 5/2002 | Tamaki et al. | |
| 2005/0186931 | A1 * | 8/2005 | Laiho et al. | 455/280 |
| 2007/0262777 | A1 * | 11/2007 | Warntjes et al. | 324/318 |
| 2009/0135077 | A1 * | 5/2009 | Kim et al. | 343/843 |
| 2010/0190435 | A1 * | 7/2010 | Cook et al. | 455/41.1 |
| 2011/0128200 | A1 * | 6/2011 | Hossain et al. | 343/745 |

FOREIGN PATENT DOCUMENTS

| | | | |
|---|---|---|---|
| EP | 2048739 | A1 | 4/2009 |
| WO | WO 99/43040 | A1 | 9/1999 |
| WO | WO 2009/022846 | A1 | 2/2009 |

OTHER PUBLICATIONS

EPO International Search Report dated Jul. 18, 2012 for corresponding appln PCT/US12/000197.

* cited by examiner

*Primary Examiner* — Hoanganh Le
(74) *Attorney, Agent, or Firm* — Alan M. Weisberg; Christopher & Weisberg, P.A.

(57) ABSTRACT

A method and apparatus for providing a broadband near field of an antenna are disclosed. A small broadband loop antenna may include a printed circuit board (PCB) substrate with multiple layers. Printed on the PCB substrate are dual loops sharing a same driver circuit, an impedance matching network, a primary ground layer and a conductive layer. A shorting via connects the dual loops to a ground plane. The antenna may be tuned to a desired operating frequency by adjusting parameters of the loop, such as the position of the shorting via.

15 Claims, 7 Drawing Sheets

SMALL BROADBAND LOOP ANTENNA FOR NEAR FIELD APPLICATIONS

CROSS-REFERENCE TO RELATED APPLICATION

This application is related to and claims priority to U.S. Provisional Application Ser. No. 61/475,109, filed Apr. 13, 2011, entitled A SMALL BROADBAND LOOP ANTENNA FOR NEAR FIELD APPLICATIONS, the entirety of which is incorporated herein by reference.

STATEMENT REGARDING FEDERALLY SPONSORED RESEARCH OR DEVELOPMENT n/a

FIELD OF THE INVENTION

The present invention relates to antenna structures and in particular to a method and system for producing a broadband near field from a broadband loop antenna.

BACKGROUND OF THE INVENTION

Radio frequency identification (RFID) systems may be used for a number of applications, such as managing inventory, electronic access control, security systems, automatic identification of cars on toll roads and electronic article surveillance (EAS). Ultra-high frequency (UHF) (860-960 Mega Hertz (MHz)) or microwave (2.45 Giga Hertz (GHz)) RFID systems may include a RFID reader and a RFID device. The RFID reader may transmit a radio-frequency carrier signal via an antenna to the RFID device, such as an RFID inlay or RFID tag. The RFID device may respond to the carrier signal with a data signal encoded with information stored by the RFID device. The antenna connected with the reader should be tuned to operate within a predetermined operating frequency band, usually preferred broadband frequency covering the operating frequency band, such as 860-960 MHz. Known RFID antennas are designed to operate in a sub-band of this frequency in the far field of the antenna. However, many applications involve reading an RFID tag in the near field of the antenna of the reader.

It is therefore desirable to have an antenna that operates substantially throughout significant portions of a broad frequency band in the near field of the antenna for RFID security applications as well as other RFID applications.

SUMMARY OF THE INVENTION

The present invention advantageously provides a method and system for providing dual band performance in the near field of a broadband antenna. According to one aspect, a broad band antenna includes a conductive layer, a ground layer, a shorting via, a first loop, and a second loop. The shorting via connects the conductive layer to the ground layer. The first loop has a first port and a second port. The first loop may be connected at the first port to a matching circuit and connected at the second port to the shorting via. The first loop may include a first circuit element. The first loop may be tuned by adjusting at least one of the first circuit element, a shape of the first loop, a shape of the conductive layer, the matching circuit and a position of the shorting via. The second loop has a third port and a fourth port. The second loop may be connected at the third port to the matching circuit and connected at the fourth port to the shorting via. The second loop may include a second circuit element. The second loop is tunable by adjusting at least one of the second circuit element, a shape of the second loop, a shape of the conductive layer, the matching circuit and the position of the shorting via.

According to another aspect, the invention provides a method for producing an electromagnetic near field using an antenna, where the antenna includes a first loop, a second loop, a matching circuit and a shorting via. The first and second loops each have a first port and a second port. The first and second loops connect to the matching circuit at the first ports of the first and second loops and connect to the shorting via at the second ports of the first and second loops. The shorting via connects a ground plane to a conductive layer. At least one of the first and second loops includes a lumped passive circuit element. The method includes tuning the antenna to cause the first loop to radiate with substantial gain in a near field over a first frequency band between a first frequency and a second frequency. The method also includes tuning the antenna to cause the second loop to radiate with substantial gain in the near field over a second frequency band between the second frequency and a third frequency.

According to yet another aspect, the invention provides a broadband dual antenna that includes a conductive layer, a ground layer, a first insulating layer, a second insulating layer, a matching circuit, a shorting via, a first radiating element and a second radiating element. At least part of the first insulating layer and the second insulating layer are positioned between the conductive layer and the ground layer. The matching circuit is arranged to provide substantial matching of an impedance of a driver circuit to an impedance of the antenna. The shorting via connects the conductive layer to the ground layer. The conductive layer is positioned on the first insulating layer and the ground layer is positioned on the second insulating layer. The shorting via passes through the first insulating layer and the second insulating layer. The first radiating element is connected to the matching circuit at the first port and is connected to the shorting via at the second port. The second radiating element is connected to the matching circuit at the third port and connected to the shorting via at the fourth port.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
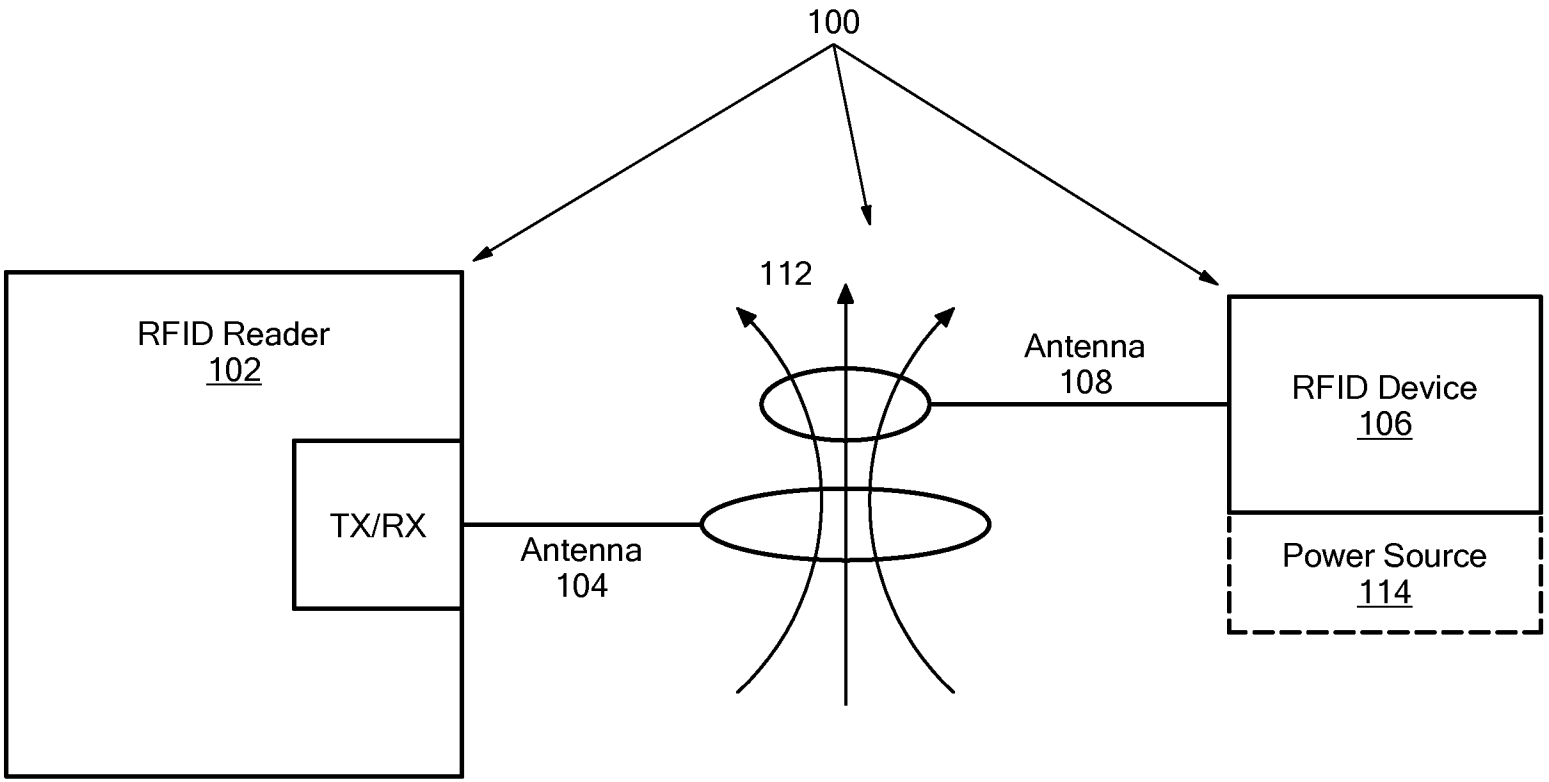
FIG. 1 is a block diagram of an exemplary radio frequency identification (RFID) system constructed in accordance with principles of the present invention.

Before describing in detail exemplary embodiments that are in accordance with the present invention, it is noted that the embodiments reside primarily in combinations of apparatus components and processing steps related to implementing a system and method for providing a small broadband antenna. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

The present invention provides a small broadband loop antenna that may include a printed circuit board (PCB) substrate with multiple layers. Printed on the PCB substrate are dual loops sharing the same driver circuit, an impedance matching network, a primary ground layer and a conductive layer. A shorting via connects the dual loops to a ground plane. The antenna may be tuned to a desired operating frequency by adjusting parameters of the loop, such as the position of the shorting via. In one embodiment, the loop antenna may be tuned to operate within an RFID operating frequency bandwidth from about 865 MHz to about 956 MHz, which encompasses the 868 MHz band used in Europe, the 915 MHz band specified by the Industrial, Scientific and Medical (ISM) agency as used in the United States, and the 953 MHz band proposed for use in Japan. Also, the broadband loop antenna may be useful for microwaves of about 2.45 GHz.

Referring now in detail to the drawings wherein like parts are designated by like reference numerals throughout, there is illustrated in FIG. 1 an RFID system constructed in accordance with principles of the present invention, and designated generally as "100". FIG. 1 shows an RFID system 100 configured to operate using an RFID device 106 having an operating frequency, such as without limitation the 868 MHz band, the 915 MHz band, the 953 MHz band, the 2.45 GHz band, and/or other portions of the RF spectrum as desired for a given implementation.

As shown in FIG. 1, RFID system 100 may include an RFID reader 102 and a RFID device 106. The RFID device 106 may include a power source 114, which can be for example either a battery or a rectifier circuit that converts some of the coupled RF electro-magnetic wave 112 into direct current power for use by the logic circuits of the semiconductor IC used to implement the RFID operations for the RFID device 106.

In one embodiment, the RFID device 106 may include an RFID tag. An RFID tag may include memory to store RFID information, and may communicate the stored information in response to an interrogation signal, such as the interrogation signals 112. The RFID information may include any type of information capable of being stored in a memory used by an RFID device 106. Examples of RFID information may include a unique tag identifier, a unique system identifier, an identifier for the monitored object, and so forth. The types and amount of RFID information are not limited in this context.

In one embodiment, the RFID device 106 may have a passive RFID security tag. A passive RFID security tag does not use an external power source, but rather uses the interrogation signals 112 as a power source. The RFID device 106 may be activated by a direct current voltage that is developed as a result of rectifying the incoming RF carrier signal comprising the interrogation signals 112. Once the RFID device 106 is activated, it may then transmit the information stored in its memory register via response signals.

In operation, when the antenna 108 of the RFID device 106 is in proximity of the RFID reader antenna 104, an AC voltage develops across the antenna 108. The AC voltage across the antenna 108 is rectified. When the rectified power is sufficient to activate the RFID device 106, the RFID device 106 may start to send stored data in its memory register by modulating the interrogation signals 112 of the RFID reader 102 to form response signals. The RFID reader 102 may receive response signals and convert them into a detected serial data word bit stream representative of the information from the RFID device 106.

Figure 2:
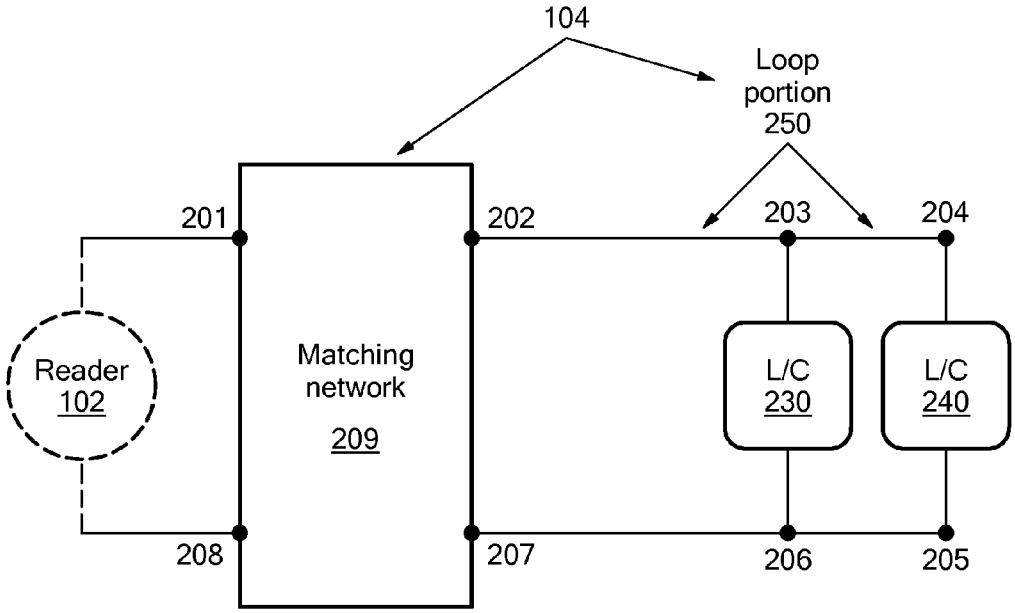
FIG. 2 is an equivalent circuit diagram of an exemplary broadband loop antenna constructed in accordance with principles of the present invention.

FIG. 2 is an equivalent circuit diagram of an exemplary broadband loop antenna constructed in accordance with principles of the present invention. As shown in FIG. 2, the antenna 104 may include a loop portion 250, a matching network 209, and two passive lumped element matching components 230 and 240. Both or either of passive lumped elements 230 and 240 can be an inductor, a capacitor, or a piece of trace. Although FIG. 2 illustrates a limited number of elements, it may be appreciated that more or less elements may be used for antenna 104. For example, two serially connected or shunted capacitors may be used to form a single capacitor with a specific value.

The matching network 209 is used to tune the loop antenna 104 to the desired working frequency band. The matching network 209 can be, without limitation, a lumped capacitor, a lumped inductor, an L matching network, a T matching network, a Pi matching network, a distributed passive inductor, a distributed passive capacitor, or a combination of these matching components.

In the embodiment of FIG. 2, the loop portion 250 has two loops. A first loop encompasses the following ports: 202, 203, 206, and 207. A second loop encompasses the following ports: 202, 203, 204, 205, 206 and 207. Thus, both loops share the same ports 202, 203, 206 and 207.

Figure 3:
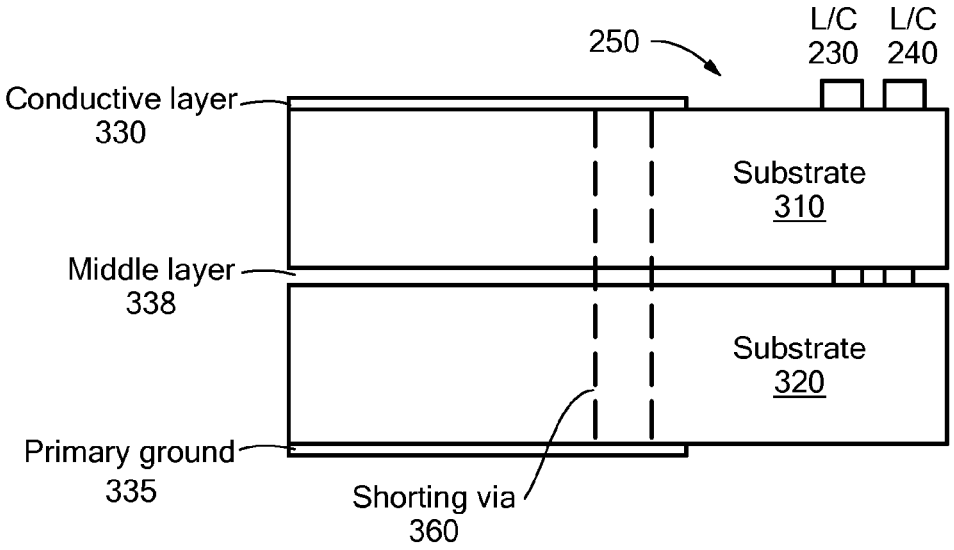
FIG. 3 is a side view of an exemplary broadband loop antenna constructed in accordance with principles of the present invention.

FIG. 3 is a side view of a broadband loop antenna constructed in accordance with principles of the present invention. As seen in FIG. 3, the loop portion 250 may include a conductive layer 330, a primary grounding layer 335, a first substrate 310, a second substrate 320, and two passive lumped impedance matching components 230 and 240, and a shorting via 360.

Substrates 310 and 320 include suitable dielectric materials and may be the same or different materials. Although the stack-up in FIG. 3 shows two layers of dielectric material, more layers can be added as desired. The particular material implemented for substrates 310 and 320 may impact the RF performance of loop portion 250. More particularly, the dielectric constant and the loss tangent may characterize the dielectric properties of appropriate substrate material or materials for use as a substrate. In one embodiment, for example, the substrates 310 and 320 may be implemented using FR4. FR4 may have a dielectric constant of about 4.4-4.6, and a loss tangent of about 0.015-0.02 at 900 MHz. Other materials exhibiting other dielectric constant and loss tangent may be used.

Figure 4:
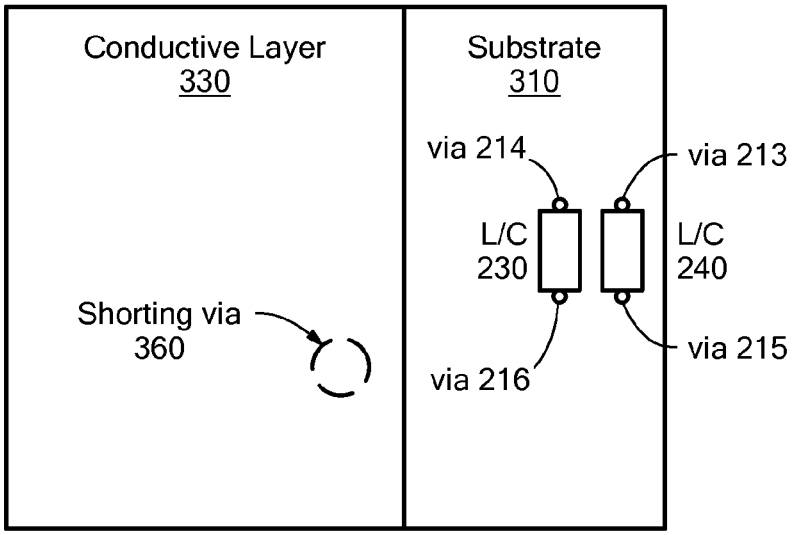
FIG. 4 is a top view of the conductive layer of the broadband loop antenna of FIG. 3.
Figure 5:
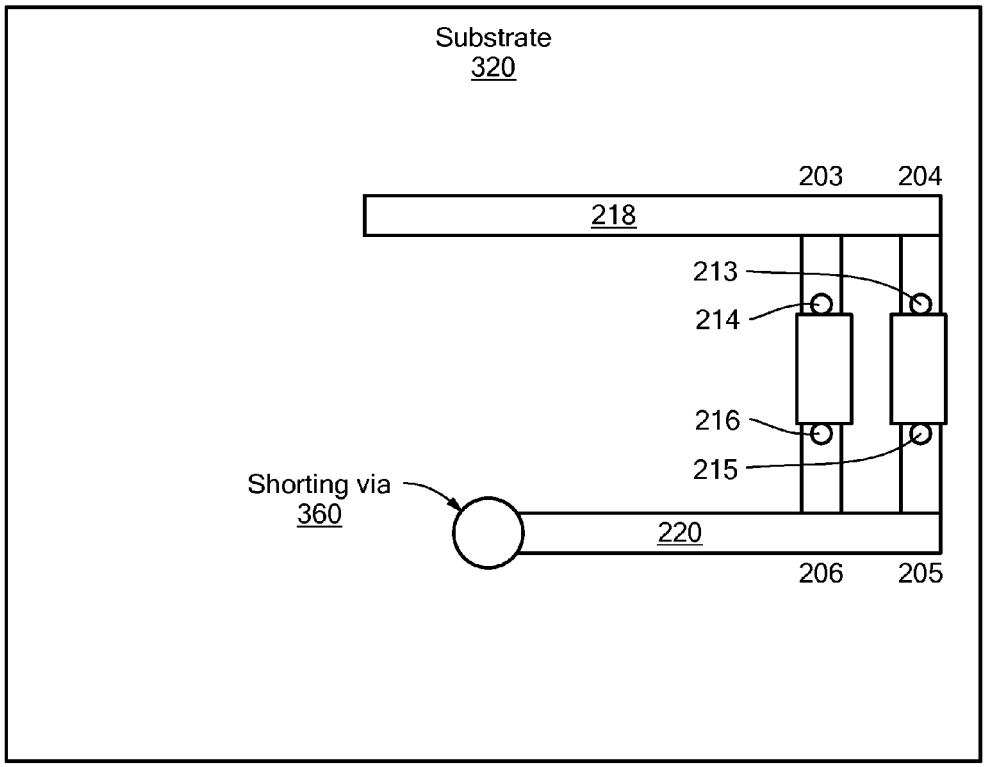
FIG. 5. is a top view of the middle layer of the broadband loop antenna of FIG. 3.

In FIG. 3, the first loop of FIG. 2 includes the lumped element 230 and is terminated at the shorting via 360. The second loop of FIG. 2 includes the lumped element 240 and is also terminated at the shorting via 360. FIG. 4 is a top view of the top layer of the broadband loop antenna of FIG. 3. FIG. 5. is a top view of the middle layer of the broadband loop antenna of FIG. 3. As can be seen by comparing FIGS. 4 and 5, the lumped element 230 is connected to the ports 203 and 206 by the vias 214 and 216, and the lumped element 240 is connected to the ports 204 and 205 by the vias 213 and 215. The lumped elements 230 and 240 are connected to the matching network 209 by a conductive strip 216 and are connected to the shorting via 360 by a conductive strip 218.

Note that although the loops formed by the conductive strips 216 and 218, the vias 213, 214, 215 and 216, and lumped elements 230 and 240 are basically rectangular in shape, other shapes may be implemented, such as circular, triangular, rectangular with rounded corners, irregular shapes or combinations thereof. Loops can also be formed by elements lying in more than one or two planes.

The first and second loops can be tuned separately, although they share the same matching network 209. For example, the first loop can be tuned by adjusting the lumped element 230 and the second loop can be tuned by adjusting the lumped element 240. Both loops may be tuned simultaneously by adjusting the position of the shorting via 360, by adjusting the thickness of the substrates 310 and 320, and/or the shape of the conductive layer 330.

For example, moving the shorting via 360 further inward from the edge of the conductive layer 330 may shift the resonant frequencies of the loops to a higher value. When the resonant frequency of the first loop is determined, the matching network 209 may be tuned to deliver good performance for distinctive frequency bands of each loop. For example, the first loop can be tuned to be resonant in a low frequency band of about 860-910 MHz, and the second loop can be tuned to be resonant in a high frequency band of about 920-960 MHz.

In a high Q circuit such as that shown in FIG. 2, the reactive impedance changes much faster as a function of frequency than the real part of the impedance. I.e., the reactive impedance has a larger slope than the real impedance. By incorporating the shorting via 360 (which may function as an inductor) and the conductive layer 330 (which may function as a capacitor), these components acting together may function as a capacitor or an inductor, depending upon the operating frequency. By appropriate design, the shorting via 360 and the conductive layer 330 can be the dominant components affecting the frequency response of the circuit, and may greatly suppress the change in reactive impedance of the circuit. As a result, the first and second loops can be tuned to first and second frequencies, respectively. Either loop can be tuned to the low frequency band while the other loop is tuned to the high frequency band.

Figure 6:
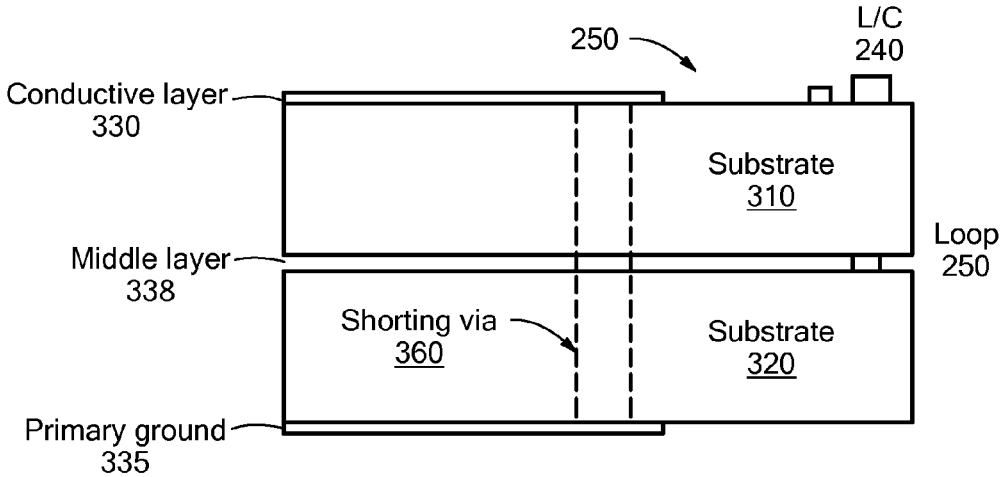
FIG. 6 is side view of an alternative exemplary embodiment of a broadband loop antenna constructed in accordance with principles of the present invention.
Figure 7:
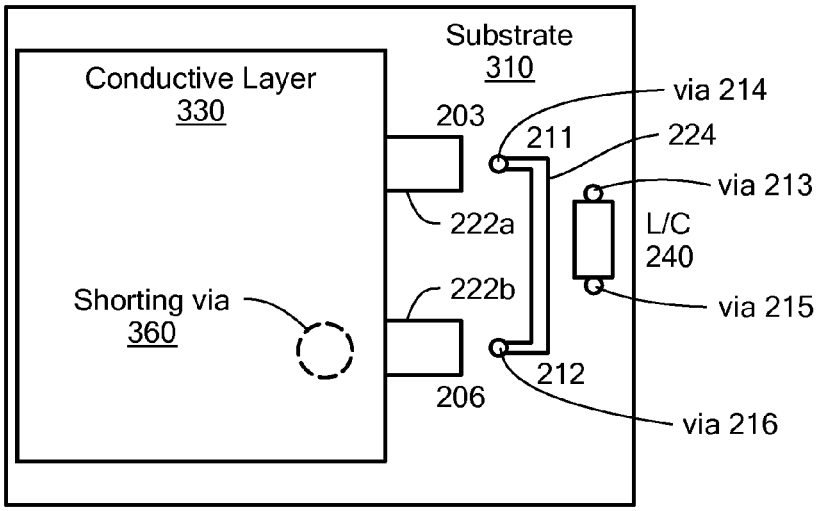
FIG. 7 is a top view of the conductive layer of the broadband loop antenna of FIG. 6.
Figure 8:
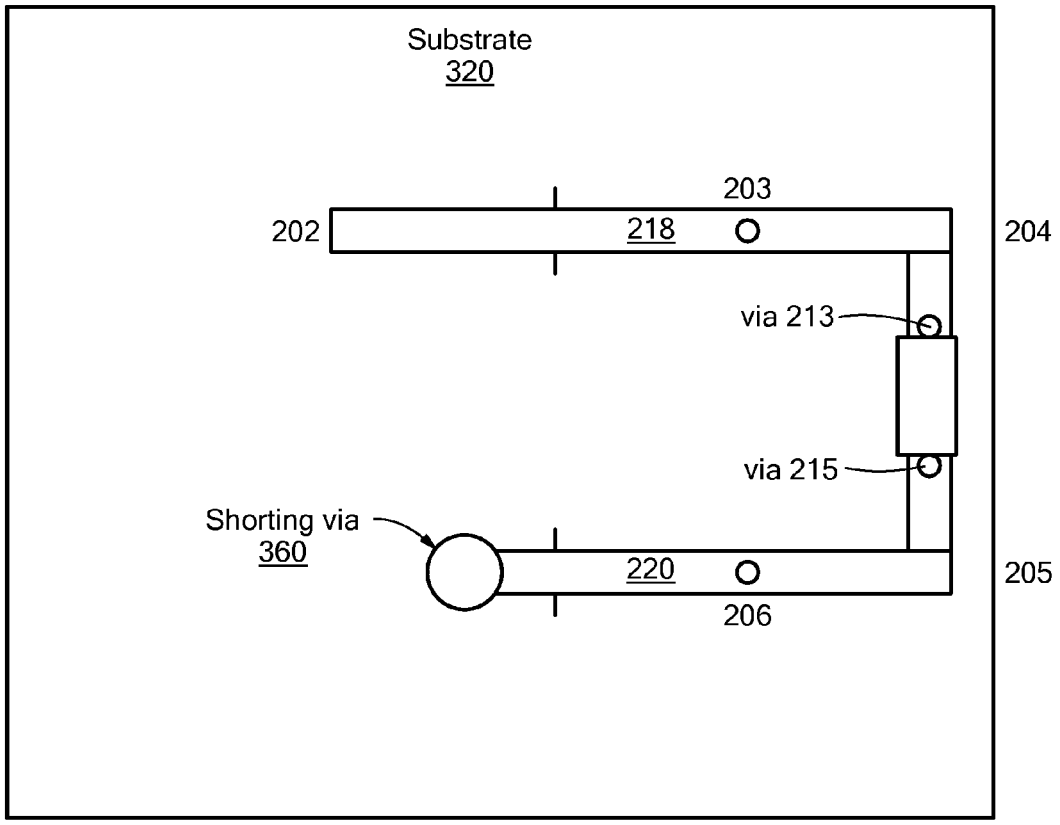
FIG. 8 is a top view of the middle layer of the broadband loop antenna of FIG. 6.

FIG. 6 is a side view of an alternative embodiment of a broadband loop antenna constructed in accordance with principles of the present invention. FIG. 7 is a top view of the top layer of the broadband loop antenna of FIG. 6. FIG. 8 is a top view of the middle layer of the broadband loop antenna of FIG. 6. Comparing the embodiment of FIGS. 3-5, the embodiment of FIGS. 6-8, the lumped element 230 of FIGS. 3-5 is replaced by a short conducting trace 224. The ports 203 and 206 are defined at the vias 214 and 216 that are closest to the conductive layer 330. Referring to FIG. 8, the ports 203 and 206 connect to conductive traces 218 and 220. Thus, the two loops—the first loop including the trace 224 (shown in FIG. 7) and the second loop including the lumped element 240 (shown in FIG. 7)—are connected physically and electrically at ports 203 and 206.

In some embodiments, the conductive layer 330 has a different shape than the primary ground plane 335. For example, FIG. 7 shows that the conductive layer 330 has two stubs **222*a* and 222*b* that extend over part of the two loops. These stubs may provide extra coupling between the conductive layer 330 and the loop portion 250. Thus, an additional way to tune the two loops includes adjusting the length and width of the stubs 222*a* and 222*b*. Other variations of the conductive layer 330 may be included for tuning In one embodiment, the primary ground layer 335 is a 1.6 inches×0.8 inches in rectangular shape, and the conductive layer 330 has the same dimensions. The first loop is a 0.2 inch×0.4 inch rectangular-shaped loop, while the other loop is a 0.2 inch×0.39 inch rectangular-shaped loop. The shorting via 360 has a diameter of 0.03 inches and is placed 0.12 inches inside of an edge of the conductive layer 330. In this particular embodiment, the layout is on a 4-layer PCB stack-up from material ISOLA370. Each of the substrates has a thickness of 0.03 inches. The passive lumped element 240** is implemented as a 5.6 pico-Farad (pF) capacitor. The matching network is realized by a shunted 1 pF capacitor and a single serially connected 22 milli-Henry (mH) inductor.

Figure 9:
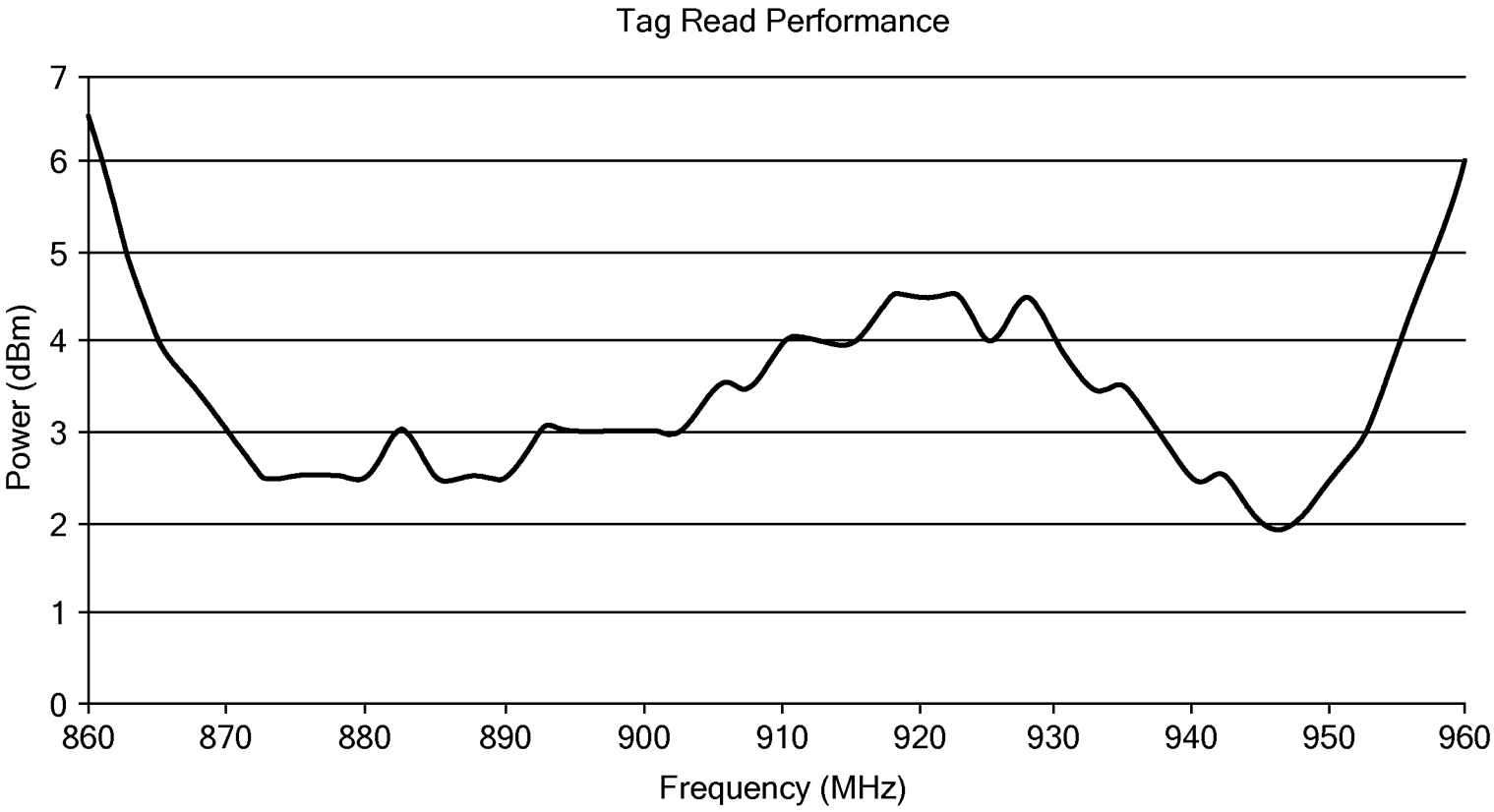
FIG. 9 is a graph of a frequency response of an exemplary broadband loop antenna constructed in accordance with principles of the present invention.

FIG. 9 shows the read performance of an exemplary embodiment of a small broadband loop antenna, such as described above, when an RFID tag is placed 1 centimeter (cm) above the top plane of the loop portion 250. As shown in FIG. 9, the antenna has two adjacent resonant frequency bands in the band between 865-956 MHz.

In one embodiment, the loop portion 250 may be enclosed in a housing. The housing may be a material applied to the loop for support and protection. The housing material may impact the radio frequency (RF) performance of the loop portion 250. For example, the housing material may include an iron base or other metal. A metallic housing may be kept a distance from the loop portion 250 to lessen the impact of the housing on the performance of the loop antenna.

The term "near field" may refer to the communication operating distance between the RFID reader 102 and the RFID device 106 as being a short distance, usually less than a wavelength of the highest operating frequency of the antenna. An example of a near field read range is about 15 cm at about 27 dBm of power, with a preferred distance of about 5 cm.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are not in direct contact with each other, but yet still co-operate or interact with each other. The embodiments are not limited in this context.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A broadband antenna, comprising:

a conductive layer;

a ground layer;

an insulating layer positioned between the conductive layer and the ground layer;

a shorting via, the shorting via passing through the insulating layer and electrically connecting the conductive layer to the ground layer;

a first loop, the first loop having a first port and a second port, the first loop connected at the first port to a matching circuit and connected at the second port to the shorting via, the first loop including a first circuit element, the first loop being tunable by adjusting at least one of the first circuit element, a shape of the first loop, a shape of the conductive layer, the matching circuit and a position of the shorting via;

a second loop, having a third port and a fourth port, the second loop connected at the third port to the matching circuit and connected at the fourth port to the shorting via, the second loop including a second circuit element, the second loop being tunable by adjusting at least one of the second circuit element, a shape of the second loop, a shape of the conductive layer, the matching circuit and the position of the shorting via; and at least a portion of the first loop and the second loop being separated by the insulating layer.

2. The antenna of claim 1, wherein the first loop and the second loop lie in a same plane, the first port and the third port share a first common conductor, and the second port and the fourth port share a second common conductor.

3. The antenna of claim 1, wherein the first loop is parallel to the conductive layer.

4. The antenna of claim 1, wherein the second circuit element includes a lumped passive circuit element, the second loop being tunable by adjusting the lumped passive circuit element.

5. The antenna of claim 1, wherein the first circuit element is a lumped passive circuit element.

6. The antenna of claim 1, wherein the first circuit element is a conducting strip.

7. The antenna of claim 1, wherein the first loop is tuned by adjusting the matching circuit and the second loop is tuned by adjusting the position of the shorting via.

8. The antenna of claim 1, wherein the first loop is rectangular, having dimensions substantially equal to 0.2 inches by 0.4 inches.

9. The antenna of claim 1, wherein the shorting via is positioned substantially 0.12 inches from an edge of the conductive layer.

10. A method for producing an electromagnetic near field using an antenna, the antenna comprising a first loop, a second loop, a matching circuit, a ground plane, a conducting layer, an insulating layer between the ground plane and the conducting layer and a shorting via passing through the insulating layer and electrically connecting the conductive layer to the ground layer, the first and second loops each having a first port and a second port, the first and second loops connected to the matching circuit at the first ports of the first and second loops and connected to the shorting via at the second ports of the first and second loops, at least one of the first and second loops including a lumped passive circuit element, the method comprising:

tuning the antenna to cause the first loop to radiate with substantial gain in a near field over a first frequency band between a first frequency and a second frequency; and tuning the antenna to cause the second loop to radiate with substantial gain in the near field over a second frequency band between the second frequency and a third frequency.

11. The method of claim 10, wherein tuning the antenna to cause the first loop to radiate in the near field over the first frequency band includes adjusting at least one of a shape of the first loop, a lumped passive circuit element and a position of the shorting via.

12. The method of claim 11, wherein tuning the antenna to cause the second loop to radiate in the near field over the second frequency band includes adjusting at least one of a shape of the second loop, a lumped passive circuit element and a position of the shorting via.

13. The method of claim 10, wherein tuning the antenna to cause the first loop to radiate in the near field over the first frequency band includes adjusting a geometry of the antenna to cause the first loop to radiate over a 3dB bandwidth that is substantially greater than 20 Mega-Hertz (MHz).

14. The method of claim 13, wherein tuning the antenna to cause the second loop to radiate in the near field over the second frequency band includes adjusting a geometry of the antenna to cause the second loop to radiate over a 3dB bandwidth that is substantially greater than 10 MHz.

15. An antenna, comprising:

a conductive layer;

a ground layer;

a first insulating layer;

a second insulating layer, at least part of the first insulating layer and the second insulating layer being positioned between the conductive layer and the ground layer a matching circuit, the matching circuit being arranged to provide substantial matching of an impedance of a driver circuit to an impedance of the antenna;

a shorting via, the shorting via connecting the conductive layer to the ground layer, the conductive layer positioned on the first insulating layer and the ground layer positioned on the second insulating layer, the shorting via passing through the first insulating layer and the second insulating layer;

a first radiating element having a first port and a second port, the first radiating element connected to the matching circuit at the first port and connected to the shorting via at the second port, the first radiating element being positioned on a same side of the first insulating layer as the conductive layer; and a second radiating element having a third port and a fourth port, the second radiating element connected to the matching circuit at the third port and connected to the shorting via at the fourth port, the second radiating element being positioned between the first insulating layer and the second insulating layer.

* * * * *